US008052625B2

(12) United States Patent
Tsai et al.

(10) Patent No.: US 8,052,625 B2
(45) Date of Patent: Nov. 8, 2011

(54) MASSAGE DEVICE

(76) Inventors: Ming-Wei Tsai, Taipei Hsien (TW); Chung-Kwok Wong, Xiamen (CN)

( * ) Notice: Subject to any disclaimer, the term of this patent is extended or adjusted under 35 U.S.C. 154(b) by 659 days.

(21) Appl. No.: 12/240,933

(22) Filed: Sep. 29, 2008

(65) Prior Publication Data

US 2010/0081973 A1 Apr. 1, 2010

(51) Int. Cl.
*A61H 7/00* (2006.01)
*A61H 1/00* (2006.01)

(52) U.S. Cl. ..... 601/15; 601/87; 601/112; 601/134

(58) Field of Classification Search ..... 601/15, 601/23, 24, 26, 27, 31, 32, 84, 86, 87, 89, 601/90, 92, 93, 94, 97, 101, 112, 113, 115, 601/122, 126, 127, 134
See application file for complete search history.

(56) References Cited

U.S. PATENT DOCUMENTS 7,322,946 B2 * 1/2008 Lev et al. ..... 601/15
7,597,669 B2 * 10/2009 Huang ..... 601/86
7,722,553 B2 * 5/2010 Lev et al. ..... 601/15
2005/0209538 A1 * 9/2005 Lev et al. ..... 601/15
2006/0129072 A1 * 6/2006 Shin ..... 601/18
2009/0306559 A1 * 12/2009 Tsai ..... 601/128

* cited by examiner

*Primary Examiner* — Quang D Thanh
(74) *Attorney, Agent, or Firm* — Birch, Stewart, Kolasch & Birch, LLP

(57) ABSTRACT

A massage device includes an outer casing, a driving mechanism and at least one massage module. The massage module includes an inclined rotary plate coupled to a main gear seat having central massage balls. When the inclined rotary plate rotates, the main gear seat and the central massage ball are driven to rotate. The main gear seat engages with a plurality of planetary gears, each of which is coupled with a massage arm. An upper end of the massage arm has a peripheral massage ball disposed thereon and a lower end of the massage arm contacts with the inclined rotary plate. A rotation of the inclined rotary plate drives massage arms and the peripheral massage balls thereon to rotate via the planetary gear as well as to move the massage arms up and down, thereby providing a massage of kneading and acupressure.

10 Claims, 5 Drawing Sheets

MASSAGE DEVICE

BACKGROUND OF THE INVENTION

1. Field of the Invention

The present invention relates generally to a massage device, and more particularly to a massage device that provides massage with heat setting.

2. Description of the Related Art

A conventional massage device, such as a foot, back or neck massage device, comprises an outer casing in which a driving mechanism is received to drive the rotation of massage balls. When the massage device is put in contact with the human body, the rotation of the massage balls provides a massage action. The driving mechanism usually includes a motor coupled with a worm shaft. The worm shaft drives intermediary gears and the intermediary gears drive a follower gear, thereby rotating the massage balls associated with the follower gear.

The massage device mentioned above can offer only one single kneading movement. Therefore, the massage device has a limited massage effect only at the skin surface level, and fails to provide a deep tissue massage for penetrating relief or improving blood circulation.

SUMMARY OF THE INVENTION

A primary objective of the present invention is to provide a massage device that offers a plurality of massage movements for improving blood circulation and relieving tension.

In order to achieve the objective, a massage device according to the present invention comprises an outer casing, a mount frame placed inside the outer casing, and massage modules mounted on the mount frame and exposed out of the outer casing. More specifically, the massage device includes driving gear sets between the driving mechanism and the massage modules. The driving mechanism comprises a motor coupled to a worm shaft. The worm shaft respectively engage with two sets of driving gears. Each set of driving gears is coupled to an inclined rotary plate on which a main gear seat having central massage balls is mounted. A gear plate is provided with a plurality of planetary gears engaged with the main gear seat. An outer periphery of the planetary gears commonly engages with a ring gear. When the main gear seat drives the planetary gears in movement, the ring gear drives the entire gear plate to rotate relative to the main gear seat. Further, each of the planetary gears is coupled with a massage arm. An upper end of the massage arm is coupled to a peripheral massage ball, and a lower end of the massage arm is in contact with the inclined rotary plate. When the planetary gears rotate, the peripheral massage ball provided on the upper end of each massage arm also rotates. Owing to the contact between the lower end of each massage arm and the inclined rotary plate, a rotation of the inclined rotary plate also causes the massage arm to move up and down. In addition, the gear plate may also be provided with a plurality of heater elements.

When the massage device is put in contact with the user's body, the rotating main gear seat drives the central massage balls thereon to rotate. Moreover, the rotating planetary gears make the peripheral massage balls disposed on the massage arms to rotate. The rotating inclined rotary plate makes the peripheral massage balls disposed on the massage arms to move up and down. As a result, the peripheral massage balls on the massage arms rotate and move up and down. Thus, the massage device according to the present invention provides kneading and deep tissue acupressure.

The massage device according to the present invention provides a massage to two regions, a central massage region and a peripheral massage region. Compared to conventional massage devices, the massage device according to the present invention is capable of massaging over a larger area to promote blood circulation and relieve tension in an effective manner. Moreover, the massage device comprises heater elements that may be activated by the user to further sooth aching muscles.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
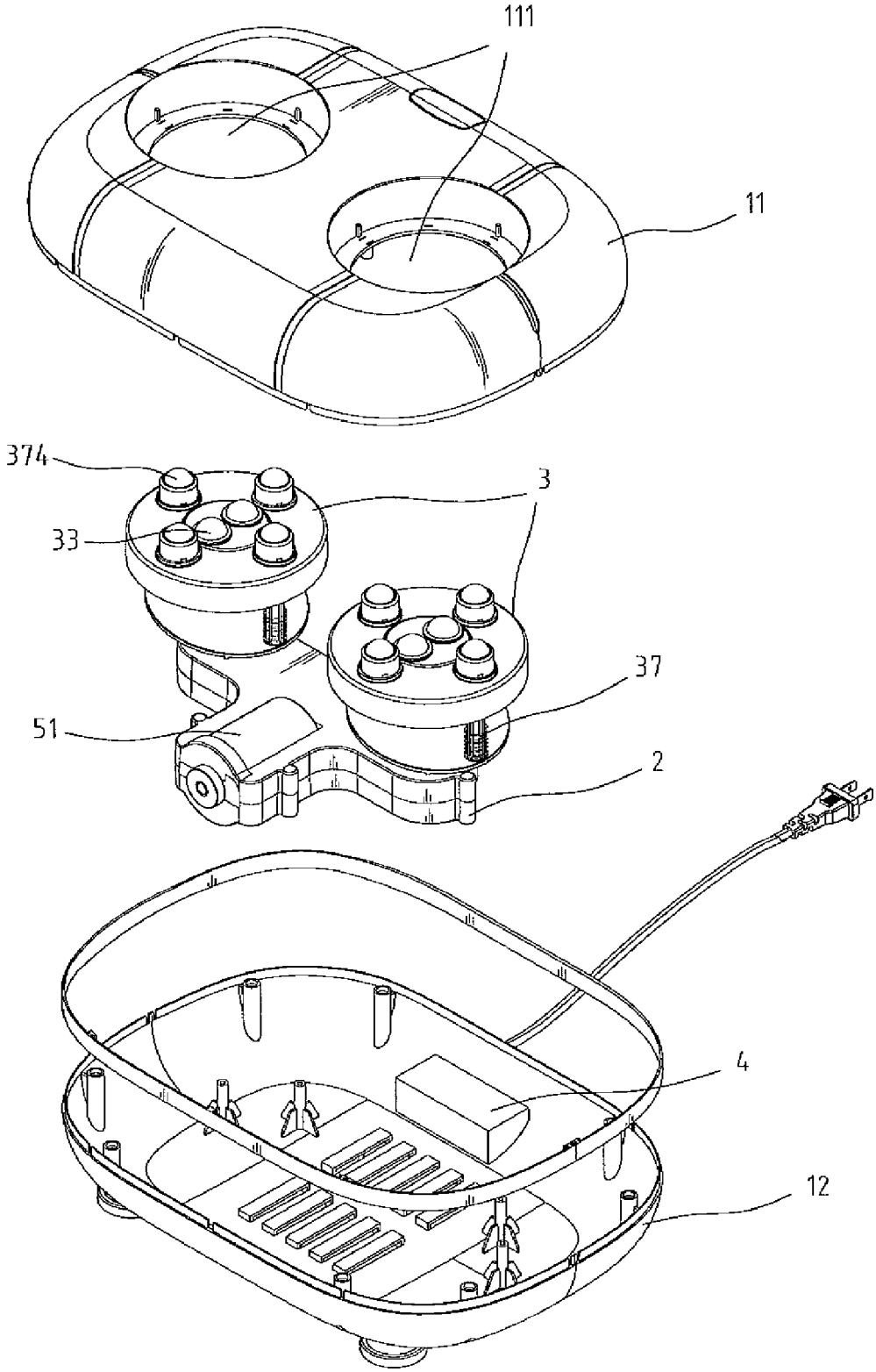
FIG. 1 is an exploded view showing a massage device according to the present invention.

Referring to FIGS. 1 to 4, a massage device according to the present invention comprises an outer casing 1, a mount frame 2, two massage modules 3 mounted on the mount frame 2, an electrical controller 4 and a driving mechanism 5. The outer casing 1 includes an upper casing 11 and a lower casing 12 and an inner space is defined between the upper casing 11 and the lower casing 12. The mount frame 2 having the massage modules 3 mounted thereon is received in the inner space. The electrical controller 4 is provided with a circuit board, wires, switches, buttons, electronic components, etc and is securely fixed on the lower casing 12. The upper casing 11 comprises two casing openings 111 through which the massage modules 3 protrude outward to apply massage actions.

The mount frame 2 has an upper cover 21 and lower cover 22 that define a mounting space for receiving the driving mechanism 5 adapted to drive the massage modules 3.

Figure 2:
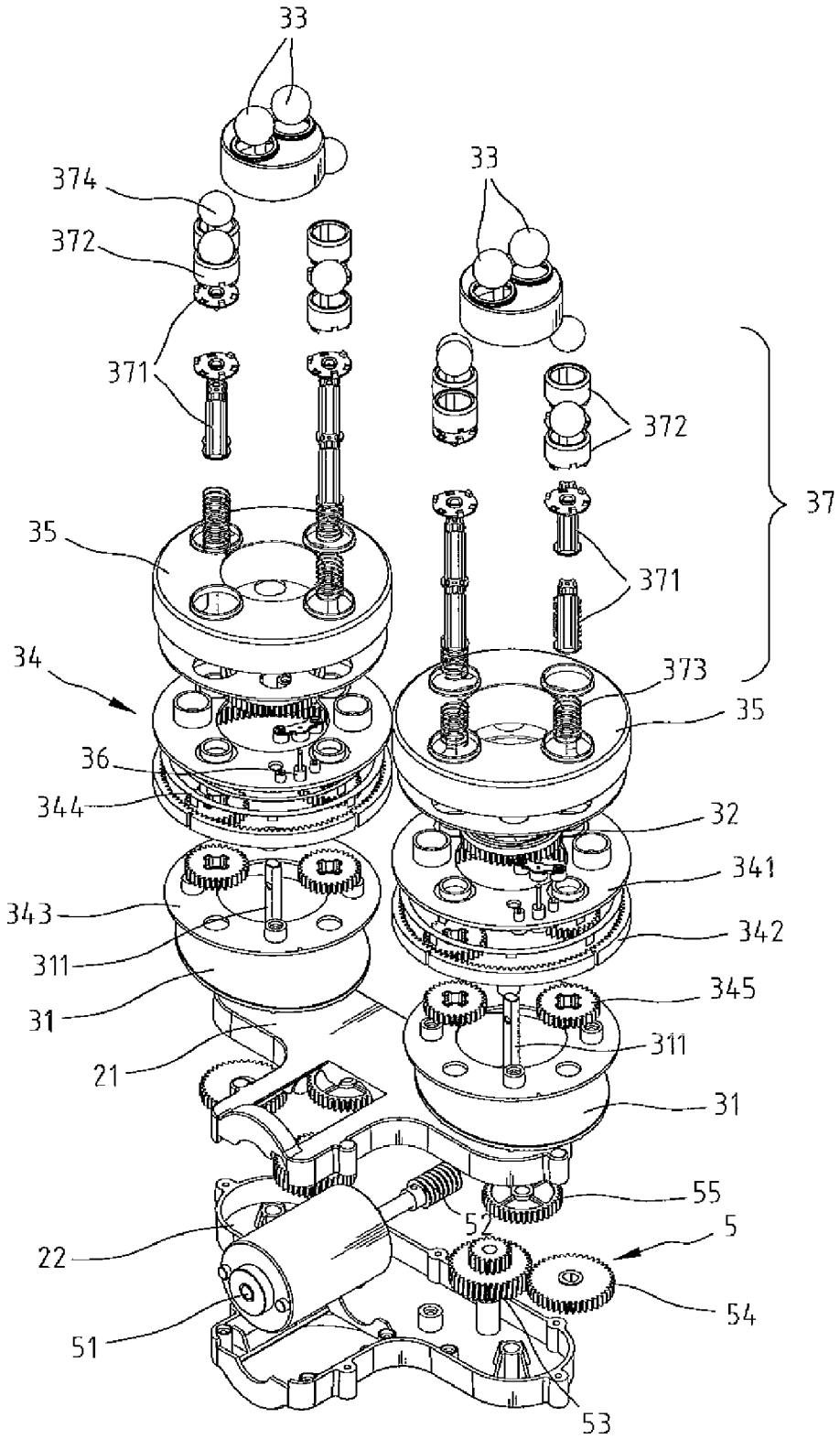
FIG. 2 is an exploded view illustrating a driving mechanism, a mount frame and massage modules of the massage device according to the present invention.
Figure 3:
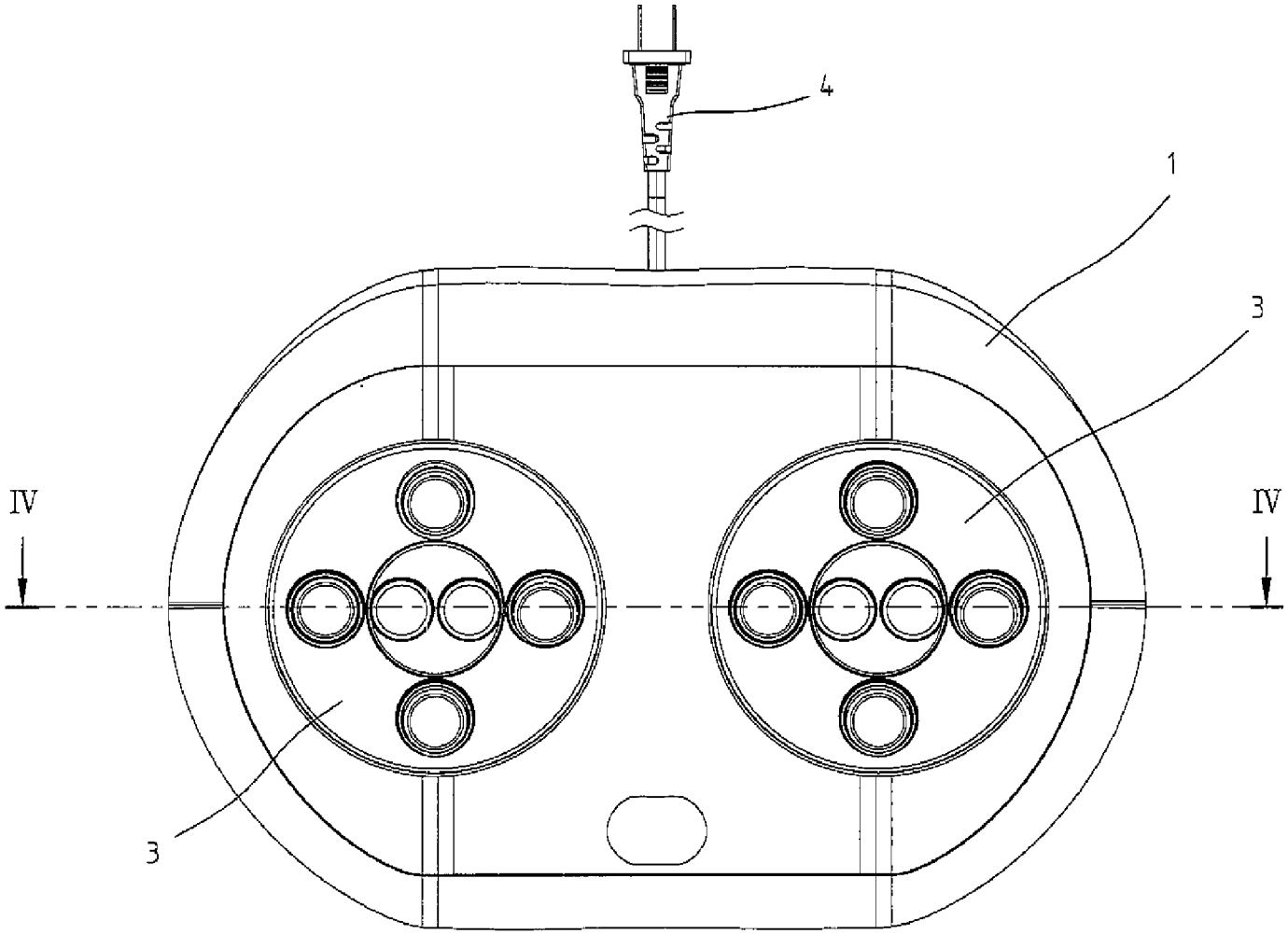
FIG. 3 is a top view showing the massage device according to the present invention.
Figure 4:
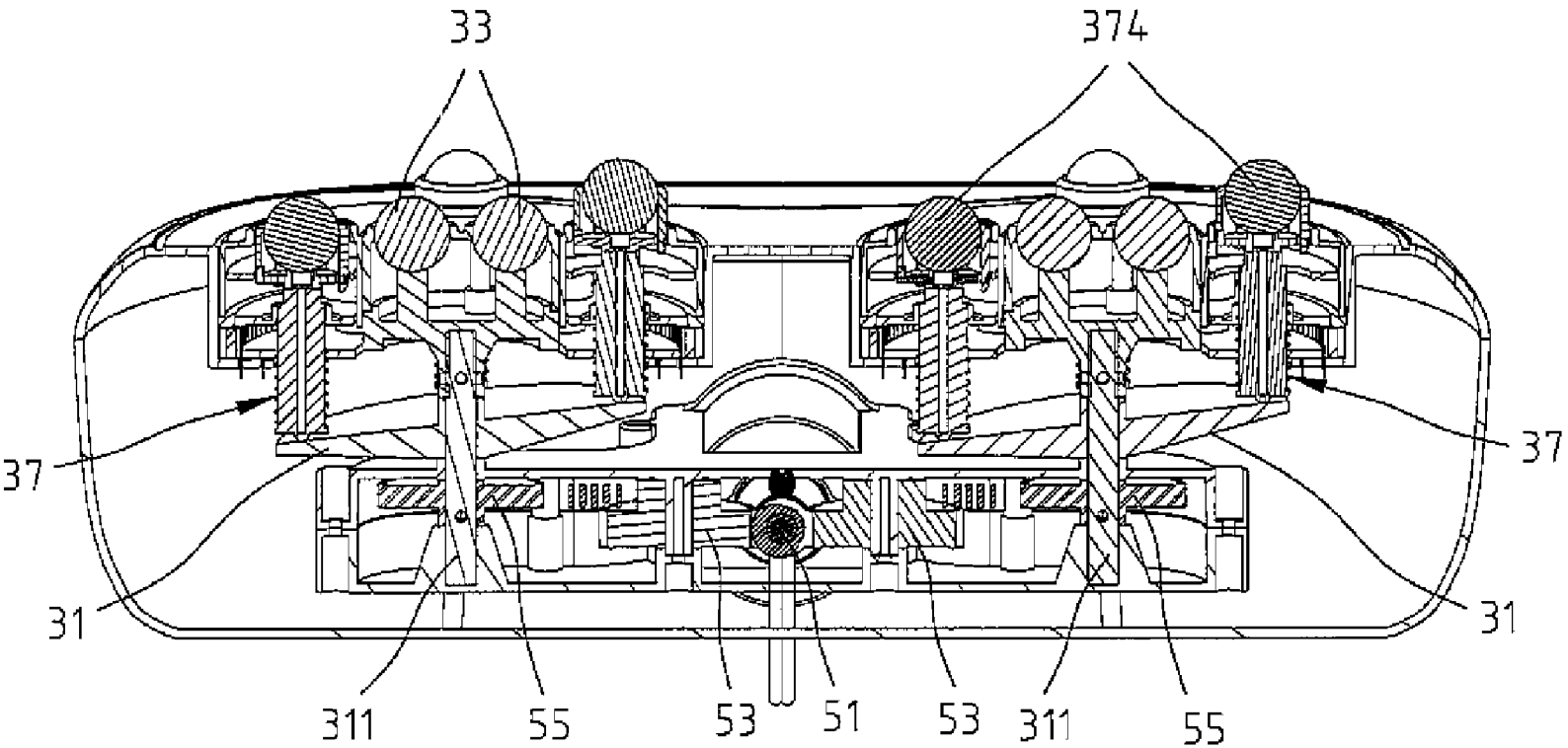
FIG. 4 is a cross-sectional view taken along line IV-IV in FIG. 3.

Referring to FIGS. 2 and 4, the driving mechanism 5 comprises a motor 51 and a worm shaft 52 coupled to the motor 51. The worm shaft 52 is engaged with two sets of driving gears. Each set of the driving gears comprises a plurality of intermediary gears and a follower gear. The intermediary gears includes a duplex gear 53 engaged with the worm shaft 52 and a first spur gear 54 engaged with the duplex gear 53. The follower gear includes a second spur gear 55 engaged with the first spur gear 54. The massage device according to the present invention has at least one set of the driving gears. Each set of the driving gears has a corresponding massage module 3 to couple therewith.

Two massage modules 3 are arranged symmetrically on a top surface of the upper cover 21 of the mount frame 2. Each of the massage modules 3 includes an inclined rotary plate 31 having a slant plate surface and a rotary axle 311. A lower end of the rotary axle 311 passes through the upper cover 21 to couple with the second spur gear 55. An upper end of the rotary axle 311 is coupled to a main gear seat 32 provided with a plurality of central massage balls 33. A ring-shaped gear plate 34 comprises a first fixing plate 341, a ring gear 342 and a second fixing plate 343 coupled to the ring gear 342. A flexible separator ring 344 is disposed between the first fixing plate 341 and the ring gear 342. A plurality of planetary gears 345 is disposed on the second fixing plate 343. The ring gear 342 is engaged with an outer periphery of the planetary gears 345 and the planetary gears 345 also engage with the main gear seat 32. A ring-shaped gear plate cover 35 is mounted over the gear plate 34. The gear plate cover 35 has a plurality of the cover openings corresponding to the planetary gears 345. A plurality of heater elements 36 is disposed on a surface of the first fixing plate 341. The heater elements 36 are electrically connected to the electrical controller 4, and may be miniature lamps, for example. Each of the massage modules 3 comprises a plurality of massage arms 37 corresponding to the planetary gears 345. Each massage arm 37 comprises a movable shaft 371, a ball seat 372 fixed on an upper end of the movable shaft 371, and a peripheral massage ball 374 disposed in the ball seat 372. The movable shaft 371 passes through the gear plate cover 35 and the first fixing plate 341, couples with the planetary gear 345, and passes through the second fixing plate 343. A lower end of the movable shaft 371 has an extruded edge and contacts with the inclined rotary plate 31. The ball seats 372 are exposed out of the cover opening of the gear plate cover 35. A spring 373 is mounted around the movable shaft 371 and disposed between the second fixing plate 343 and the inclined rotary plate 31. The gear plate 34 and gear plate cover 35 are assembled and received in the casing opening 111 of the upper casing 11. The massage arm 37 is restrictedly movable between the gear plate cover 35 and the inclined rotary plate 31. The central massage balls 33 and the peripheral massage balls 374 are exposed out of the upper casing 11. The central massage balls 33 and the peripheral massage balls 374 can be made of plastics, metal, glass, ceramic, etc.

After the massage device is powered on, the motor 51 and worm shaft 52 are activated to drive the two sets of driving gears. More particularly, the worm shaft 52 drives the duplex gear 53, the duplex gear 53 drives the first spur gear 54 and the first spur gear 54 drives the second spur gear 55. Because the rotary axle 311 couples with the second spur gear 55, the rotary axle 311 spins with the second spur gear 55. The rotary axle 311 couples with the inclined rotary plate 31 and the main gear seat 32, so the rotary axle 311 drives the inclined rotary plate 31 and the main gear seat 32 to rotate. The central massage balls 33 are disposed on the main gear seat 32. Therefore, the central massage balls 33 rotate with the main gear seat 32. A kneading massage is thereby applied when the rotating central massage balls 33 are put in contact with the body. Furthermore, the main gear seat 32 drives the planetary gears 345 and the planetary gears 345 drive the ring gear 342 to rotate, thereby rotating the entire gear plate 34. As a result, the movable shafts 371 coupled with the planetary gears 345 rotates along with the gear plate 34, thereby rotating the peripheral massage ball 374 disposed in the ball seat 372 coupled to the movable shaft 371. As the inclined rotary plate 31 rotates, each of the movable shafts 371 in contact with the inclined rotary plate 31 moves up and down. When the peripheral massage balls 374 are put in contact with the body, in addition to the kneading, the massage device also provides acupressure caused by the up and down movements of the peripheral massage balls 374.

Figure 5:
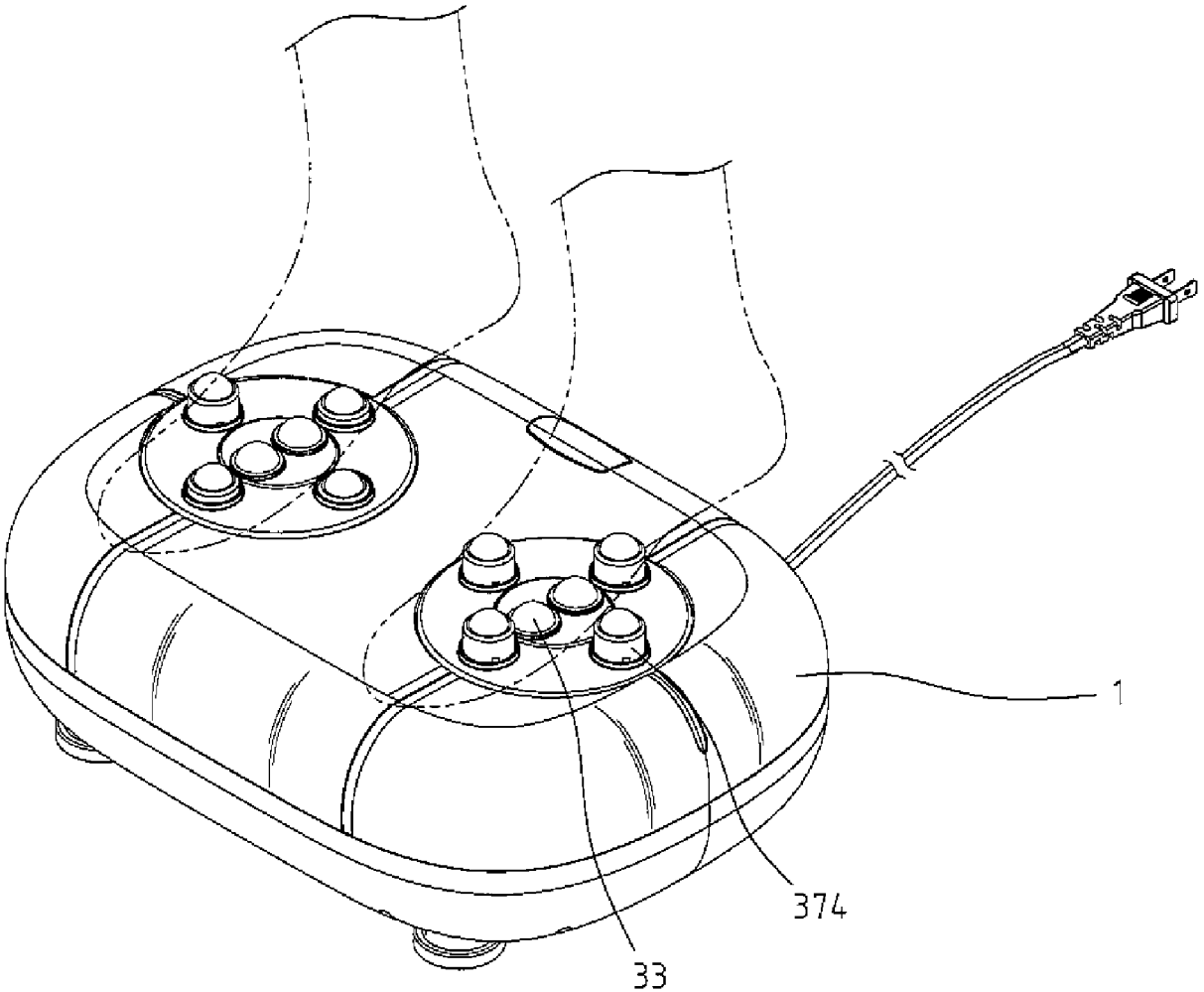
FIG. 5 is a perspective view illustrating the massage device according to the present invention used for a foot massage.

The massage device according to the present invention is versatile on various body regions, such as foot, back, neck, aims, thighs and calves, etc. FIG. 5 is a perspective view illustrating the massage device is used to give a foot massage. By turning on a switch (not shown), the heater elements 36 on the gear plate 34 may also be activated to dispense heat to sooth the muscle. In addition, the gear plate cover 35 may be made of a transparent material. When the heater elements 36, such as the miniature lamps, are activated, the light of the heater elements 36 passes through the gear plate cover 35, thereby enhancing the aesthetics of the massage device.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A massage device comprising:

an outer casing having an inner space and a plurality of casing openings;

a mount frame disposed in the inner space of the outer casing, the mount frame comprising an upper cover and lower cover assembled together to define a mounting space;

a driving mechanism disposed in the mounting space, the driving mechanism comprising a motor and at least one set of driving gears; and at least one massage module corresponding to the set of the driving gears, the massage module mounted on the upper cover of the mount frame and comprising:

an inclined rotary plate having an inclined plate surface and a rotary axle connected to the set of the driving gears;

a main gear seat coupled to the rotary axle, a plurality of central massage balls disposed on the main gear seat; and a gear plate comprising a plurality of planetary gears engaged with the main gear seat, each of the planetary gears coupled with a massage arm, an upper end of the massage arm has a peripheral massage ball disposed thereon, a lower end of the massage arm contacted with the inclined rotary plate;

wherein the central massage balls and the peripheral massage balls protrude out of the casing openings of the outer casing; and an electrical controller comprising a circuit board, a key and a switch, the electrical controller connected to the motor;

wherein the central massage balls rotates with the main gear seat, thereby providing a kneading action; rotation of the inclined rotary plate and the planetary gears drive the peripheral massage balls to rotate and move up and down, thereby providing a kneading action and an acupressure action.

2. The massage device as claimed in claim 1, wherein the driving mechanism comprises a worm shaft coupled to the motor, the worm shaft is engaged with the set of the driving gears, the set of the driving gears comprises a plurality of intermediary gears and a follower gear, the follower gear is coupled with the rotary axle of the inclined rotary plate.

3. The massage device as claimed in claim 1, wherein the gear plate comprises a ring gear engaged with an outer periphery of the planetary gears to drive the gear plate.

4. The massage device as claimed in claim 1, wherein the massage arm comprises a movable shaft and a ball seat disposed on an upper end of the movable shaft, a lower end of the movable shaft is provided with an extruded edge and contacted with the inclined rotary plate, a spring is mounted around the movable shaft, the movable shaft is coupled with the planetary gear, and the ball seat receives the peripheral massage ball.

5. The massage device as claimed in claim 1, wherein the massage module further comprises a gear plate cover mounted over the gear plate, and the massage arm is restrictedly movable between the gear plate cover and the inclined rotary plate.

6. The massage device as claimed in claim 5, wherein the gear plate comprises a plurality of heater elements electrically connected with the electrical controller.

7. The massage device as claimed in claim 6, wherein the heater element includes a miniature lamp.

8. The massage device as claimed in claim 4, wherein the massage module further comprises a gear plate cover mounted over the gear plate, and the massage arm is restrictedly movable between the gear plate cover and the inclined rotary plate.

9. The massage device as claimed in claim 8, wherein the gear plate comprises a plurality of heater elements electrically connected with the electrical controller.

10. The massage device as claimed in claim 9, wherein the heater element includes a miniature lamp.

* * * * *